US008699911B2

(12) United States Patent
Kaneko

(10) Patent No.: US 8,699,911 B2
(45) Date of Patent: Apr. 15, 2014

(54) IMAGE FORMING APPARATUS WITH FIRST AND SECOND ABUTTING PORTIONS FOR A CARTRIDGE

(75) Inventor: Tamotsu Kaneko, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 300 days.

(21) Appl. No.: 13/014,883

(22) Filed: Jan. 27, 2011

(65) Prior Publication Data

US 2011/0188887 A1 Aug. 4, 2011

(30) Foreign Application Priority Data

Jan. 29, 2010 (JP) ..... 2010-017580

(51) Int. Cl.
*G03G 15/00* (2006.01)
*G03G 21/16* (2006.01)

(52) U.S. Cl.
USPC ..... 399/110; 399/111

(58) Field of Classification Search
USPC ..... 399/110, 111
See application file for complete search history.

(56) References Cited

U.S. PATENT DOCUMENTS 5,675,893 A 10/1997 Yamada et al.
5,907,750 A 5/1999 Yamada et al.
7,519,310 B2 * 4/2009 Yamaguchi et al. ..... 399/111
2001/0031152 A1 10/2001 Kaneko et al.
2006/0024080 A1 2/2006 Chadani et al.
2007/0141889 A1 6/2007 Chadani et al.
2009/0297215 A1 * 12/2009 Munetsugu et al. ..... 399/111

FOREIGN PATENT DOCUMENTS

JP 2001242671 9/2001

* cited by examiner

*Primary Examiner* — G. M. Hyder
(74) *Attorney, Agent, or Firm* — Fitzpatrick, Cella, Harper & Scinto

(57) ABSTRACT

An image forming apparatus for forming an image on a recording material, wherein a cartridge including at least a photosensitive drum is detachably mountable to said image forming apparatus, said image forming apparatus includes a first abutting portion, provided in an upstream side with respect to a mounting direction in which the cartridge is moved in its longitudinal direction to be mounted to said apparatus; a first urging means, provided in an upstream side with respect to the mounting direction, for urging, when the cartridge is mounted to said apparatus, the cartridge, in a direction crossing with a center axis of the photosensitive drum to position the cartridge in the crossing direction; a second abutting portion, provided in a downstream side with respect to the mounting direction; and a second urging means, provided in a downstream side with respect to the mounting direction, for urging, when the cartridge is mounted to said apparatus, the cartridge, in a direction crossing with the center axis of the photosensitive drum to position the cartridge in the crossing direction, wherein said first abutting portion and said second abutting portion are disposed opposite from each other with respect to a plane including the center axis.

6 Claims, 6 Drawing Sheets

(a)

(b)

(a)

(b)

(a)

(b)

IMAGE FORMING APPARATUS WITH FIRST AND SECOND ABUTTING PORTIONS FOR A CARTRIDGE

FIELD OF THE INVENTION AND RELATED ART

The present invention relates to an image forming apparatus which forms an image on recording medium, and in which a cartridge having at least a photosensitive drum is removably mountable.

In the field of an image forming apparatus which uses an electrophotographic image formation process, it has been a common practice to employ a process cartridge system, which integrally places an electrophotographic photosensitive member, and means for processing the electrophotographic photosensitive member, in a cartridge which is removably mountable in the main assembly of an electrophotographic image forming apparatus. A process cartridge system makes it possible for a user to maintain an electrophotographic image forming apparatus by him- or her-self, that is, without relying on a service person. Thus, it can drastically improve an image forming apparatus in operability. Therefore, this system has come to be widely used in the field of an electrophotographic image forming apparatus.

The operation of an electrophotographic image forming apparatus is as follows: First, an electrostatic latent image is formed on the peripheral surface of an electrophotographic photosensitive drum by scanning the peripheral surface of the photosensitive drum with a beam of light projected from a laser, an LED, an ordinary lamp, or the like, while being modulated according to the information of an image to be formed. Then, this electrostatic latent image is developed by a developing apparatus. Then, the developed latent image, that is, the image formed of developer, on the peripheral surface of the photosensitive drum is transferred onto recording medium to form an image on the recording medium.

There have been known various types of an image forming apparatus which employ a process cartridge such as the one described above. One of them has been known as an electrophotographic color image forming apparatus of the so-called inline type, which employs multiple process cartridges which are sequentially arranged in parallel in the main assembly of the image forming apparatus. As one of the structural arrangements for precisely positioning multiple process cartridges relative to the main assembly of an image forming apparatus, there is the one disclosed in Japanese Laid-open Patent Application 2001-242671. According to this document, the left and right plates in the main assembly of the image forming apparatus are provided with slots (V-shaped cut) for precisely positioning the photosensitive drum of each process cartridge. More specifically, the lengthwise end portions of the photosensitive drum are fitted with a pair of bearings, one for one. Each of the pair of bearings is kept under the pressure from a torsional coil spring (pressure applying member) so that the peripheral surface of each bearing is kept pressed upon the edges of the corresponding slot, whereby the photosensitive drum remains precisely position relative to the main assembly of the image forming apparatus. Further, one end of the torsional coil spring is provided with a V-shaped projection. Thus, as the process cartridge is inserted into the main assembly, this V-shaped projection comes into contact with the bearing, being thereby rotated while resisting the force applied thereto by the bearing. Then, as the cartridge is inserted further, the bearing is made to ride over the V-shaped projection of the torsional coil spring. Then, as soon as the bearing rides over the V-shaped projection, the V-shaped projection presses, and keep pressed, the bearing upon the edges of the abovementioned slot (V-shaped cut).

SUMMARY OF THE INVENTION

It has become a common practice to install a process cartridge (process cartridges) in the main assembly of an image forming apparatus before packaging the image forming apparatus for shipment. This practice, however, creates a problem. That is, the preciseness in the positional relationship between the photosensitive drum in a process cartridge and the main assembly of an image forming apparatus is extremely important. Thus, an image forming apparatus has to be delivered to a user, with the photosensitive drum remaining precisely positioned relative to the main assembly of the image forming apparatus. In recent years, however, the reduction in image forming apparatus size, and the reduction in the distribution cost for an image forming apparatus, have reduced in size the box in which an image forming apparatus is placed for distribution, and also, have resulted in the simplification of the box. Since the smaller the packing box, the easier to handle during distribution, which results in the rough handling of the package. Therefore, it has become necessary to design such a process cartridge that is virtually immune to the shocks to which it is subjected during distribution, and also, such a cartridge holding method and a cartridge positioning method that are immune to the shocks. For example, in the case of a color image forming apparatus, the positional deviation of its photosensitive drum results in the formation of unsatisfactory images (image suffering from color deviation). Thus, it is extremely important that the photosensitive drum in a process cartridge which is installed in an image forming apparatus prior to the distribution of the apparatus is kept precisely positioned relative to the main assembly during the distribution.

The present invention is a result of further development of the prior art described above. Thus, its primary object is to provide a combination of an image forming apparatus and a process cartridge, which is capable of keeping the cartridges and the photosensitive drum therein in the same state, in terms of the accuracy with which the cartridge and photosensitive drum are positioned relative to the main assembly of the image forming apparatus, as they are when the cartridge is mounted into the main assembly, even if the image forming apparatus is subjected to external shocks.

According to an aspect of the present invention, there is provided an image forming apparatus for forming an image on a recording material, wherein a cartridge including at least a photosensitive drum is detachably mountable to said image forming apparatus, said image forming apparatus comprising a first abutting portion, provided in an upstream side with respect to a mounting direction in which the cartridge is moved in its longitudinal direction to be mounted to said apparatus; a first urging means, provided in an upstream side with respect to the mounting direction, for urging, when the cartridge is mounted to said apparatus, the cartridge, in a direction crossing with a center axis of the photosensitive drum to position the cartridge in the crossing direction; a second abutting portion, provided in a downstream side with respect to the mounting direction; and a second urging means, provided in a downstream side with respect to the mounting direction, for urging, when the cartridge is mounted to said apparatus, the cartridge, in a direction crossing with the center axis of the photosensitive drum to position the cartridge in the crossing direction, wherein said first abutting portion and said second abutting portion are disposed opposite from each other with respect to a plane including the center axis.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS

Hereinafter, one of the preferred embodiments of the present invention will be described in detail with reference to the appended drawings. The measurements, materials, and shapes of the structural components of the image forming apparatus which will be mentioned in the following description of the preferred embodiment, and the positional relationship among the structural components, are not intended to limit the present invention in scope, unless specifically noted.

Figure 1:
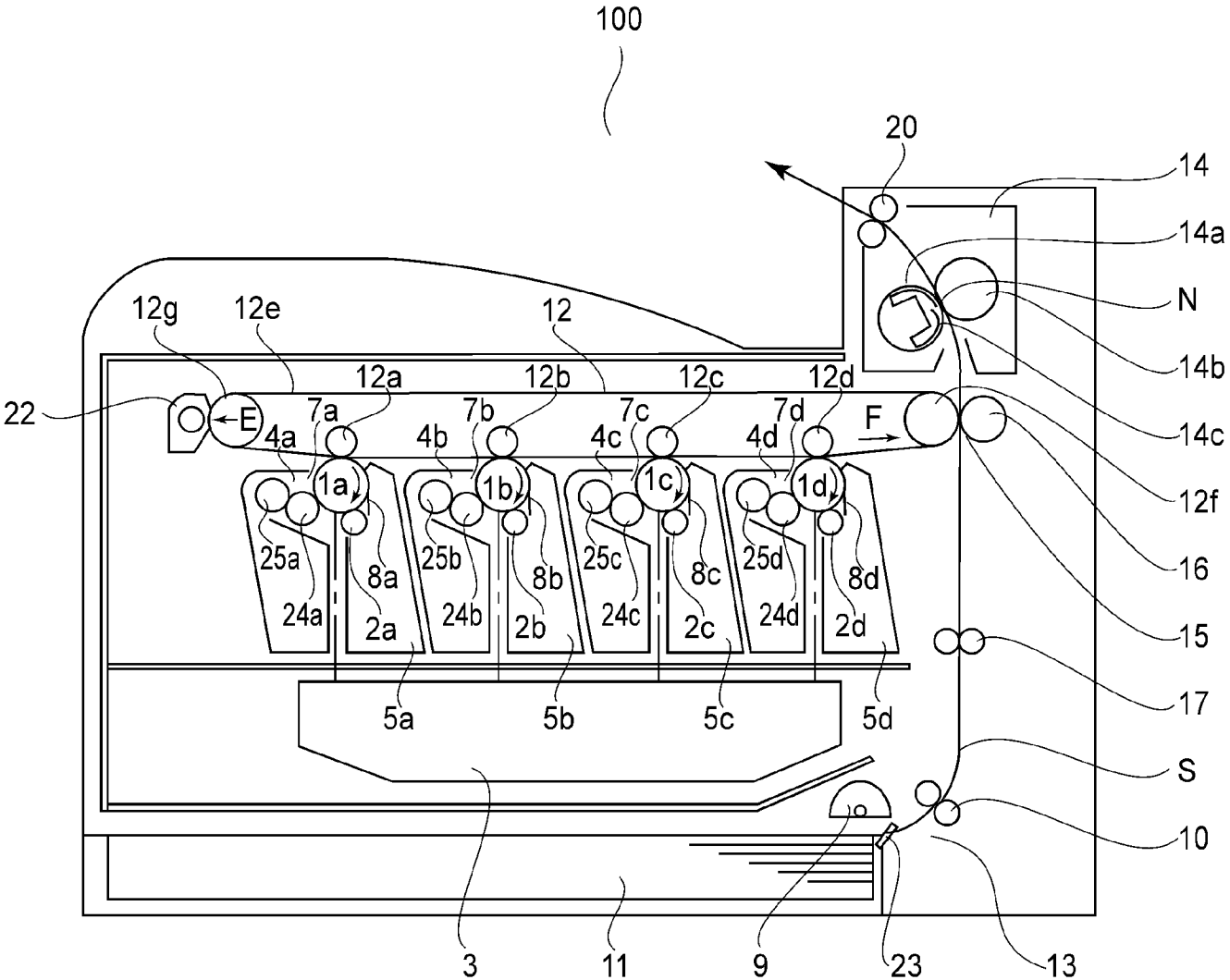
FIG. 1 is a schematic vertical sectional view of the image forming apparatus in one of the preferred embodiments of the present invention, and shows the general structure of the apparatus.

First referring to FIG. 1, the general structure of the image forming apparatus in the preferred embodiments is described. FIG. 1 is a vertical sectional view of the a color laser printer 100, which is a form of an image forming apparatus which is compatible with the present invention, and shows the general structure of the printer 100. This color laser printer 100 is a multicolor image forming apparatus which employs multiple cartridges which are removably mountable in the main assembly of the apparatus in the roughly horizontal direction.

There are four photosensitive drums (1*a*, 1*b*, 1*c*, and 1*d*) in the color laser printer 100 in FIG. 1. Further, the color laser printer 100 has also a charging means 2, a laser scanner 3, a developing means 4, a transferring means 12, a cleaning means 8, etc., listing from the first of the image forming means in terms of the rotational direction of the photosensitive drum 1, which are in the adjacencies of the peripheral surface of each of the four photosensitive drums 1. The charging means 2 (2*a*, 2*b*, 2*c*, and 2*d*) uniformly charges the peripheral surface of the photosensitive drum 1. The laser scanner 3 forms an electrostatic latent image on the peripheral surface of the photosensitive drum 1 by projecting a beam of laser light while modulating the beam according to the information of the image to be formed. The developing means 4 (4*a*, 4*b*, 4*c*, and 4*d*) develops the electrostatic latent image into a visible image (formed of toner) by adhering toner to the electrostatic latent image. The transferring means 4 (4*a*, 4*b*, 4*c*, and 4*d*) transfers the visible image (image formed of toner) on the peripheral surface of the photosensitive drum 1 onto an intermediary transfer belt 12 (intermediary transferring member). The cleaning means 8 (8*a*, 8*b*, 8*c*, and 8*d*) removes the toner remaining on the peripheral surface of the photosensitive drum 1 after the image transfer. These means make up an image forming means.

The charging means 2 (2*a*-2*d*), developing means 4 (4*a*-4*d*), and cleaning means 8 (8*a*-8*d*), which are means for processing the photosensitive drum 1 (1*a*-1*d*), are integrally placed, along with the photosensitive drum 1 (1*a*-1*d*), in a cartridge to make a process cartridge 7 (7*a*-7*d*), which is removable mountable in the main assembly of the color laser printer 100.

The four process cartridges 7*a*, 7*b*, 7*c*, and 7*d* are the same in structure, but are different in the color in which they form an image. That is, the process cartridges 7*a*, 7*b*, 7*c*, and 7*d* use yellow (Y), magenta (M), cyan (C), and black (Bk) toners (developers), respectively. Further, the process cartridges 7*a*, 7*b*, 7*c*, and 7*d* are made up of development units 4*a*, 4*b*, 4*c*, and 4*d*, and cleaner units 5*a*, 5*b*, 5*c*, and 5*d*, respectively.

The development units 4*a*, 4*b*, 4*c*, and 4*d* have development rollers 24*a*, 24*b*, 24*c*, and 24*d*, developer application rollers 25*a*, 25*b*, 25*c*, and 25*d*, and toner containers, respectively.

The cleaner units 5*a*, 5*b*, 5*c*, and 5*d* have photosensitive drums 1*a*, 1*b*, 1*c*, and 1*d*, charge rollers 2*a*, 2*b*, 2*d*, and 2*d*, drum cleaning blades 8*a*, 8*b*, 8*c*, and 8*d*, and waster toner containers, respectively.

The photosensitive drums 1*a*, 1*b*, 1*c*, and 1*d*, each of which is an image bearing member, are made up of a hollow cylindrical member (metallic cylinder, for example), and a photosensitive layer formed on the peripheral surface of the cylindrical member by coating the peripheral surface of the hollow cylindrical member with an organic photoconductive substance (OPC). The photosensitive drum 1 is rotatably supported by its lengthwise ends, by a pair of flanges, one for one. It is rotated in the clockwise direction, indicated by an arrow mark in the drawing, by the force transmitted to one of its lengthwise ends from a motor (unshown). The photosensitive drum 1 is in the portion of each process cartridge, which will be the top portion of the cartridge when the cartridge is in the main assembly of the image forming apparatus.

Each of the charging means 2*a*, 2*b*, 2*c*, and 2*d* is an electrically conductive roller. The charging means 2*a*, 2*b*, 2*c*, and 2*d* are in contact with the photosensitive drums 1*a*, 1*b*, 1*c*, and 1*d*, respectively. The peripheral surface of the photosensitive drum 1 is uniformly charged by placing the charge roller 2 in contact with the peripheral surface of the photosensitive drum 1 and applying charge bias to the charging means 2 from an electrical power source (unshown), while the photosensitive drum 1 is rotated.

The laser scanner 3, which is an exposing means, is directly below the space for the group of process cartridges 7*a*, 7*b*, 7*c*, and 7*d*. It scans the peripheral surface of each of the four photosensitive drums 1*a*, 1*b*, 1*c*, and 1*d* to form a latent image which reflects image formation signals, on the peripheral surface of each photosensitive drum 1.

Each of the development units 4*a*, 4*b*, 4*c*, and 4*d* is made up of a toner storage portion, a development roller, etc. The toner storage portions of the development units 4*a*, 4*b*, 4*c*, and 4*d*, one for one, store yellow (Y), magenta (M), cyan (C), and black (Bk) toners, respectively. Each development roller is positioned so that its peripheral surface is virtually in contact with the peripheral surface of the corresponding photosensitive drum 1. It is rotated by a driving portion (unshown). As development bias is applied to the development roller by a development bias power source while it is rotated, the latent image is developed.

The photosensitive drums 1*a*, 1*b*, 1*c*, and 1*d* are charged by the charge rollers 2*a*, 2*b*, 2*c*, and 2*d*, and then, an electrostatic latent image is formed on each of the four photosensitive drums 1*a*, 1*b*, 1*c*, and 1*d* by the laser scanner 3. Then, the four electrostatic latent images are developed in reverse by the development units 4*a*, 4*b*, 4*c*, and 4*d*, one for one; toner is adhered to the peripheral surface of the photosensitive drum 1 in the pattern of the electrostatic latent image. Thus, toner images of yellow (Y), magenta (M), cyan (C), and black (Bk) colors are effected on the photosensitive drums 1*a*, 1*b*, 1*c*, and 1*d*, respectively.

The intermediary transfer belt unit 12 has an intermediary transfer belt 12*e*, which is in the top portion of the main assembly of the image forming apparatus and is in contact with each of the four photosensitive drums 1. The intermediary transfer belt 12*e* is an endless belt. It is suspended and tensioned by a driver roller 12*f* and a tension roller 12*g*. The tension roller 12*g* provides the intermediary transfer belt 12*e* with a preset amount of tension, by pulling the intermediary transfer belt 12*e* in the direction indicated by an arrow mark E. There are transfer rollers 12*a*, 12*b*, 12*c*, and 12*d*, which are within the loop, which intermediary transfer belt 12*e* forms. They oppose the photosensitive drums 1*a*, 1*b*, 1*c*, and 1*d*, respectively. To the transfer rollers 12, transfer bias is applied by a bias applying means (unshown).

The four toner images formed on the photosensitive drums 1*a*, 1*b*, 1*c*, and 1*d*, one for one, are transferred (first transfer) onto the intermediary transfer belt 12*e* by the application of bias to the first transfer rollers 12*a*, 12*b*, 12*c*, and 12*d*, respectively. More specifically, the toner images on the photosensitive drums 1 are sequentially transferred (first transfer) onto the intermediary transfer belt 12*e*, starting from the one on the photosensitive drum 1*a*, so that the four monochromatic toner images, different in color, are placed in layers on the intermediary transfer belt 12*e*. The layered four monochromatic toner images are conveyed to a second transferring portion 15.

A sheet feeding apparatus 13 has: a sheet feeder cassette 11, in which multiple sheets S of recording medium are storable; a feed roller 9 which feeds sheets S, one by one, into the main assembly of the image forming apparatus 100; and a pair of sheet conveying rollers 10 which convey further each sheet S after the feeding of the sheet S into the main assembly. Incidentally, "recording medium" means an object on which an image can be formed by an image forming apparatus. It includes ordinary paper, OHP sheet, and the like.

Referring to FIG. 1, the main assembly of the image forming apparatus, and the sheet feeder cassette 11, are structured so that the cassette 11 can be pulled out of the main assembly in the frontward direction of the main assembly. If it is necessary to supply the main assembly with sheets S of recording medium, a user is to pull the sheet feeder cassette 11 out of the main assembly, and fill the cassette 11 with sheets S of recording medium. Then, the user is to insert the cassette 11 into the main assembly to complete the process of supplying the main assembly with the sheets S of recording medium. As the cassette 11 is inserted into the main assembly, the sheets S come under the pressure from the feed roller 9. As an image forming operation begins, each sheet S is fed into the main assembly while being separated from the rest in the cassette 11 by a separation pad 23 (frictional separation system). After being fed into the main assembly by the sheet feeding apparatus 13, each sheet S is conveyed to the second transferring portion 15 by a pair of registration roller 17.

The second transferring portion 15 is made up of the driver roller 12*f* and a second transfer roller 16, which are kept pressed against each other with the presence of the intermediary transfer belt 12*e* between them. As transfer bias is applied to the second transfer roller 16 by a bias applying means (unshown), the layered four monochromatic toner images, different in color, on the intermediary transfer belt 12*e*, are transferred together (second transfer) onto the sheet S of recording medium, which is being conveyed through the second transferring portion 15.

A fixing portion 14, which is a fixing means, fixes the transferred toner images on the sheet S to the sheet S by applying heat and pressure to the toner images.

Designated by a referential code 14*a* is a fixation belt, which is cylindrical and is guided by a belt guiding member 14*c* which has a heat generating means, such as an ordinary heater, attached to the belt guiding member 14*c* with adhesive or the like. Designated by a referential code 14*b* is an elastic pressure roller, which is kept pressed against the belt guiding member 14*c* by a preset amount of pressure, with the presence of the fixation belt 14*a* between the pressure roller 14*b* and belt guiding member 14*c*. Thus, there is a fixation nip N, which is preset in width, between the fixation belt 14*a* and elastic pressure roller 14*b*. As the pressure roller 14*b* is rotated by a driving means (unshown), the cylindrical fixation belt 14*a* is rotated by the rotation of the pressure roller 14*b*, while being heated by the heater (unshown) within the belt guiding member 14*c*. With the temperature of the fixation nip N having increased to a preset level, the sheet S on which a layered unfixed toner images are present, is conveyed from the image forming means into the fixation nip N, that is, the interface between the fixation belt 14*a* and pressure roller 14*b*, with the image bearing surface of the sheet S facing upward, that is, facing the fixation belt 14*a*. Thus, the sheet S is conveyed through the fixation nip N with the image bearing surface of the sheet S remaining in contact with the outward surface of the fixation belt 14*a*, while remaining tightly pinched between the fixation belt 14*a* and pressure roller 14*b*.

While the sheet S of recording medium is conveyed through the fixation nip N, remaining in contact with the fixation belt 14*a* which is being rotated, the layered unfixed monochromatic toner images on the sheet S become fixed to the sheet S by being heated by the heat from the heater which is on the inward side of the fixation belt loop. After the fixation of the toner images to the sheet S, the sheet S is discharged by a pair of discharge rollers 20 into a delivery tray 21.

Meanwhile, the toner remaining on the peripheral surface of photosensitive drum 1 (1*a*, 1*b*, 1*c*, and 1*d*) after the first transfer of the toner images is removed by the cleaning blade 8*a*, 8*b*, 8*c*, and 8*d*, respectively, and is recovered into the waste toner contains of the cleaner units 5*a*, 5*b*, 5*c*, and 5*d*, respectively.

As for the toner remaining on the intermediary transfer belt 12*e* after the second transfer, that is, the toner image transfer onto the sheet S, is removed by a transfer belt cleaning apparatus 22, and is recovered into a waste toner recovery container (unshown), through a waste toner conveyance passage.

Figure 2:
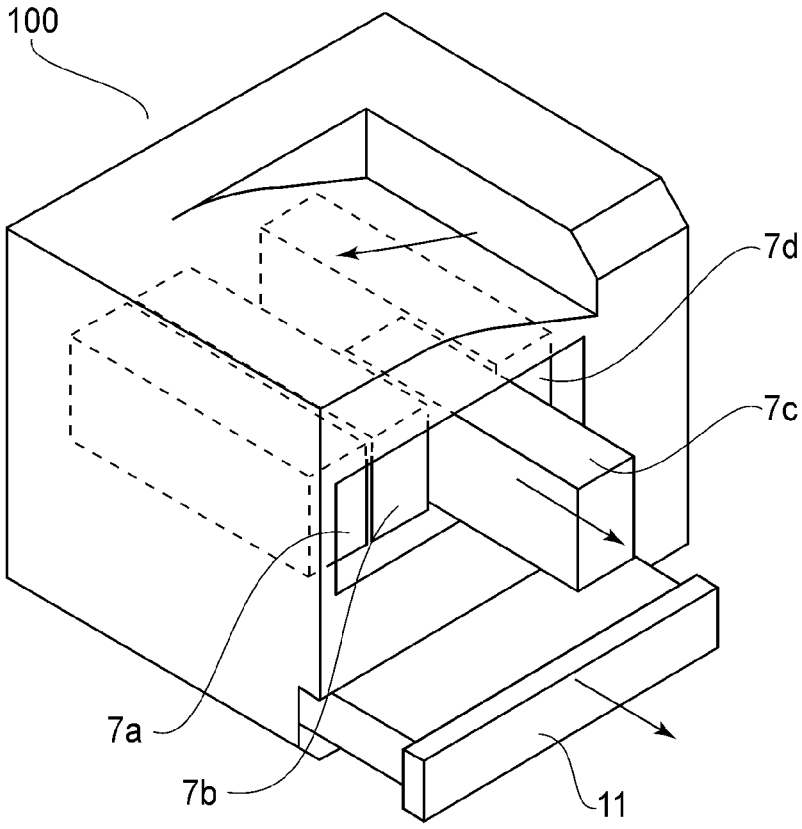
FIG. 2 is a schematic perspective view of the image forming apparatus, shown in FIG. 1, and the process cartridges therefor, and shows the method for mounting or dismounting the process cartridge, and the method for mounting a sheet feeder cassette.

Next, the portions of the structure of the color laser beam printer 100, which is related to the mounting of the process cartridge 7 into the main assembly of the printer 100, and the removal of the cartridge 7 from the main assembly, are described. FIG. 2 is a schematic perspective view of the image forming apparatus, four cartridges 7 (three of which are in main assembly of printer, whereas one is being pulled out of main assembly), and sheet feeder cassette 11, and shows the method for mounting the process cartridges 7, method for removing the process cartridges 7, method for mounting the sheet feeder cassette 11, and method for removing the sheet feeder cassette 11.

It is from the front side of the color laser printer 100 that the sheet feeder cassette 11 is mounted into the printer 100 to supply the printer 100 with the sheets S of recording medium; the process cartridges 7 are mounted into, or removed from, the main assembly of the image forming apparatus; and the sheet S of recording medium is collected after the printing of an image on the sheet S. The printer 100 is structured so that each of the process cartridges 7 is to be mounted into, or removed from, the main assembly of the printer 100 in the direction parallel to the axial line of the photosensitive drum 1 in the process cartridge 7, and also, from the front side of the main assembly. Here, the "front side" of the main assembly of the printer 100 means the side on which a user is to be when mounting the cartridge 7, that is, the upstream side of the printer 100 in terms of the direction in which the cartridge 7 is inserted into the main assembly. The "rear side" of the main assembly of the printer 100 means the opposite side of the main assembly from the "front side" of the main assembly, that is, the downstream side of the main assembly in terms of the direction in which the cartridge 7 is inserted into the main assembly.

Figure 3:
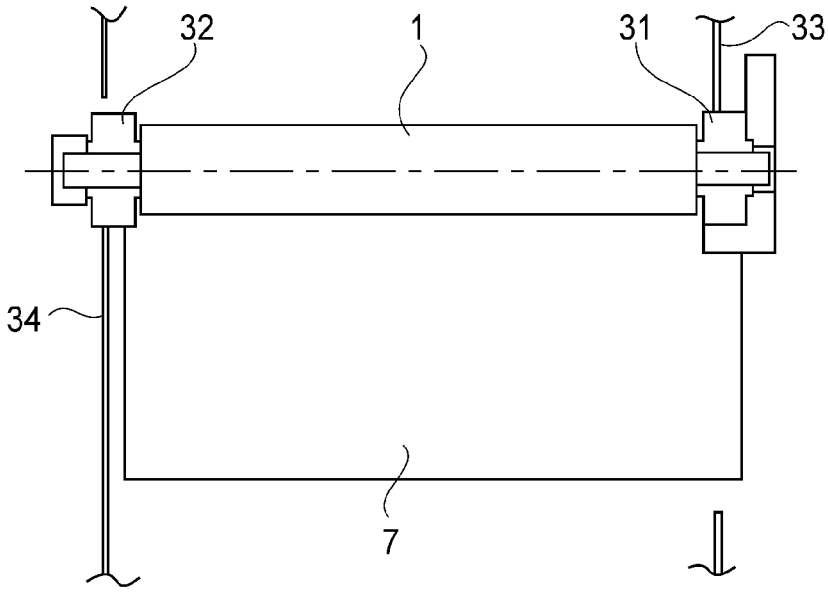
FIG. 3 is a schematic sectional view of one of the process cartridges 7 supported in the main assembly of the image forming apparatus 100, at a vertical plane which coincides with the axial line of the photosensitive drum 1, as seen from the direction indicated by one of the arrow marks in FIG. 2.
Figure 4:
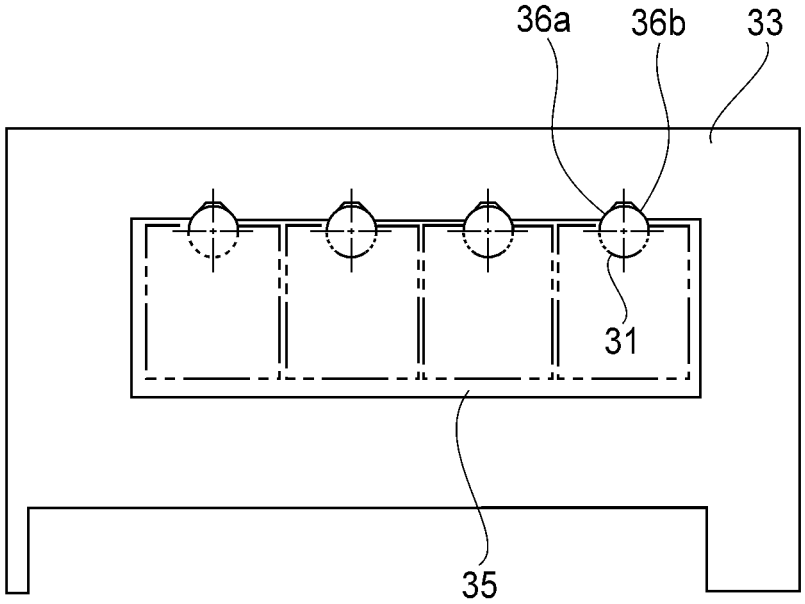
FIG. 4(*a*) is a schematic plan view of the front plate 33 of the image forming apparatus 100, as seen from the front side of the main assembly of the apparatus 100, and FIG. 4(*b*) is a schematic plan view of the rear plate 34 of the image forming apparatus 100, as seen from the front side of the main assembly of the apparatus 100.
Figure 4:
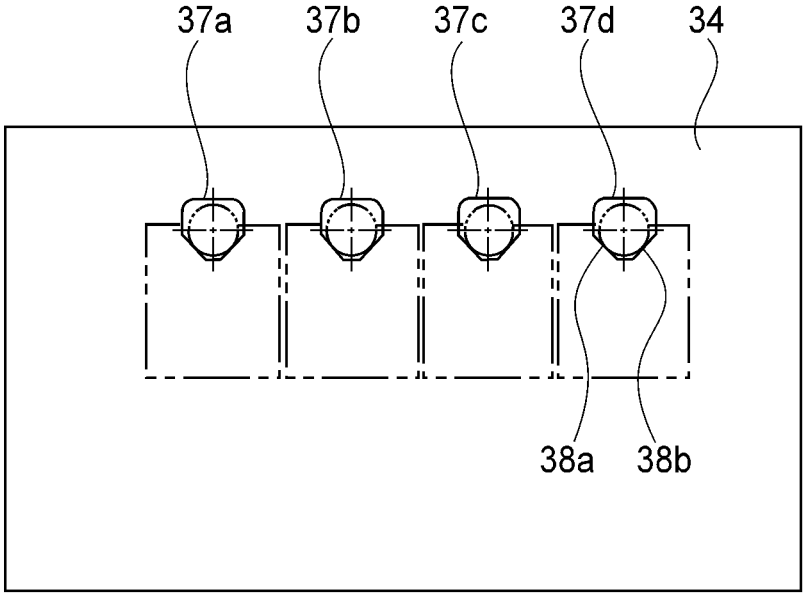

Next, referring to FIGS. 3 and 4, the portions of the structure of the main assembly of the color laser printer 100, which support the process cartridges 7, are described in detail.

FIG. 3 is a schematic sectional view of one of the process cartridges 7 supported in the main assembly of the image forming apparatus 100, at a vertical plane which coincides with the axial line of the photosensitive drum 1, as seen from the direction indicated by one of the arrow marks in FIG. 2. Referring to FIG. 3, the lengthwise end portions of the photosensitive drum 1 are fitted with a pair of bearings 31 and 32, one for one, which are made of low friction (slippery) resin and are rotatable relative to the photosensitive drum 1. That is, the bearings 31 and 32 support the photosensitive drum 1 in such a manner that the photosensitive drum 1 is rotatable in the process cartridge 7. The bearings 31 and 32 are prevented by E-rings from moving in the direction parallel to the axial line of the photosensitive drum 1. Here, the "lengthwise" direction of the photosensitive drum 1 means the direction parallel to the axial line of the photosensitive drum 1, that is, the direction in which the process cartridge 7 is mounted into, or removed from, the main assembly of the image forming apparatus 100.

The main assembly of the image forming apparatus 100 is provided with a pair of metallic plates 33 (front plate) and 34 (rear plate), which come into contact with the peripheral surface of the bearing 31 and the peripheral surface of the bearing 32, respectively, as the process cartridge 7 is mounted into the main assembly. In terms of the direction in which the process cartridge 7 is inserted into the main assembly in the direction parallel to the lengthwise direction of the cartridge 7, the front plate 33 is on the upstream side of the main assembly, whereas the rear plate 34 is on the downstream side of the main assembly. The front plate 33 and rear plate 34 are in connection with each other. More specifically, the bottom portion of the front plate 33 is in connection with the bottom portion of the rear plate 34 through a bottom plate (unshown) with which the main assembly is provided. The left, center, and top portions of the front plate 33 are in connection with the counterparts of the rear plate 34 through a stay (unshown) with which the main assembly is provided. The bottom plate and stay are formed of metal as are the front and rear plates 33 and 34. They make up a part of the frame of the image forming apparatus 100 by being connected to each other with small screws.

FIG. 4(*a*) is a schematic plan view of the front plate 33 of the image forming apparatus 100, as seen from the front side of the main assembly of the apparatus 100. Referring to FIG. 4(*a*), the front plate 33, which is a part of the aforementioned frame, has an opening 35 through which the process cartridges 7 are mounted into, or removed from, the main assembly of the image forming apparatus 100. The top edge of this opening 35 (which is perpendicular to lengthwise direction of photosensitive drum 1) has four cartridge positioning slots 36 (36*a* and 36*b*). The four cartridge positioning slots 36, which hereafter will be referred to simply as a cartridge positioning first slot, correspond to the process cartridges 7 (7*a*-7*d*), one for one. More specifically, the cartridge positioning first slot 36 is in the form of a V-shaped cut (upside-down V). Thus, it is the portions 36*a* and 36*b* of the cartridge positioning first slot 36, which correspond to the left and right portions of a letter V, that precisely position the lengthwise front end of the process cartridge 7. As the process cartridge 7 is inserted into the main assembly of the image forming apparatus 100, the peripheral surface of the bearing (circle drawn in double-dot chain line in FIG. 4(*a*)) of the process cartridge 7 comes into contact with the left and right edges 36*a* and 36*b* of the process cartridge positioning first slot 36, whereby the process cartridge 7 is precisely position relative to the main assembly of the image forming apparatus 100, in terms of the direction perpendicular to the lengthwise direction of the process cartridge 7.

FIG. 4(*b*) is a schematic plan view of the rear plate 34 of the image forming apparatus 100, as seen from the front side of the main assembly of the apparatus 100. Referring to FIG. 4(*b*), the rear plate 34, which also is a part of the aforementioned frame, has four openings 37 (37*a*-37*d*) into which the process cartridges 7 (7*a*-7*d*) fit, respectively, by their lengthwise end portion, as they are mounted into the main assembly of the image forming apparatus 100. The bottom edge of each of these openings 37 (which is perpendicular to lengthwise direction of photosensitive drum 1) is the cartridge positioning second slot 38 (38*a*-38*d*), which hereafter will be referred to simply as a cartridge positioning second slot 38. The four cartridge positioning second slots 38 correspond to the process cartridge 7 (7*a*-7*d*), one for one. More specifically, in terms of the vertical direction, the cartridge positioning second slot 38 is positioned so that after the mounting of the process cartridge 7 into the main assembly, it would be on the opposite side of the process cartridge 7 from the V-shaped (upside-down V) cartridge positioning first slot 36. Thus, as the process cartridge 7 is inserted into the main assembly of the image forming apparatus 100, the peripheral surface of the bearing 32 (circle drawn in double-dot chain line in FIG. 4(*b*)) of the process cartridge 7 comes into contact with the bottom edge of the cartridge positioning second slot 38 (38*a*-387*d*), whereby the rear end of the process cartridge 7 is precisely position relative to the main assembly of the image forming apparatus 100 in terms of the direction perpendicular to the lengthwise direction of the process cartridge 7, and is supported by the cartridge positioning second slot 38.

That is, as the process cartridge 7 is mounted into the main assembly of the image forming apparatus 100, the bearings 31 and 32 fitted around the lengthwise ends of the photosensitive drum 1, one for one, come into contact with the cartridge positioning first and second slots 36 (36*a* and 36*b*) and 38 (38*a* and 38*b*), whereby they are supported and precisely positioned relative to the main assembly by the cartridge positioning first and second slots 36 and 38. In other words, the photosensitive drum 1 (1*a*-1*d*) in the process cartridge 7 (7*a*-7*d*) is supported by the front and rear plates 33 and 34, which are the parts of the frame of the image forming apparatus 100, in such a manner that the axial line of the photosensitive drum 1 in each process cartridge 7 becomes parallel to the axial line of the photosensitive drum 1 in each of the other process cartridges 7. The cartridge positioning first and second slots 36 and 38 are the same in shape, and are symmetrically positioned with reference to a flat plane p which coincides with the axial line CL (central axial line). Not only does this structural feature allow the bearings 31 and 32 to be the same in external diameter (bearings 31 and 32 may be identical in shape and diameter), but also, ensures that the photosensitive drums 1 (1*a*-1*d*) are more precisely positioned relative to the main assembly, in parallel to each other, than they can be in the main assembly of any of the image forming apparatuses in accordance with the prior arts.

The cartridge positioning first slot 36 (36*a* and 36*b*) is the edge portion of the hole of the metallic member (front side plate), which is a part of the frame of the image forming apparatus 100. In terms of the direction in which the process cartridge 7 is mounted into the main assembly of the image forming apparatus 100, it is on the front side of the main assembly. The cartridge positioning second slot 38 (38*a* and 38*b*) also is the metallic member (side rear plate), which also is a part of the frame of the image forming apparatus 100. It is on the rear side of the main assembly. That is, each of the two cartridge positioning slots 36 and 38 is the edge portion of the hole punched through the front (rear) plate of the main assembly during a stamping process. The use of a stamping method for the manufacture of the cartridge positioning first and second slots 36 and 38 ensures that the front and rear plates are precisely processed, and therefore, that the process cartridge 7 and the photosensitive drum 1 therein are precisely positioned relative to the main assembly of the image forming apparatus 100, which in turn minimize the image forming apparatus in color deviation.

The cartridge positioning first and second slots 36 (36*a* and 36*b*) and 38 (38*a* and 38*b*) are the same in shape and are perfectly symmetrically positioned relative to each other with respect to the flat plane p which coincides with the axial line CL of the photosensitive drum 1, as described above. This structural feature, however, is not intended to limit the present invention in scope. That is, the two slots 36 and 38 do not need to be exactly the same in size, nor perfectly symmetrically positioned relative to each other with reference to the flat plane p. In other words, as long as the main assembly of the image forming apparatus 100 is structured so that the cartridge positioning first and second slots 36 and 38 are oppositely positioned with respect to the flat plane p, it is not mandatory that they are shaped, sized, and positioned as described above. Incidentally, the flat plane p in this embodiment is horizontal. However, as long as the cartridge positioning first and second slots 36 and 38 can be positioned as described above relative to each other with respect to the flat plane p, the main assembly of the image forming apparatus 100 does not need to be structured so that the flat plane p is horizontal; it may be structured so that the flat plane p is slanted.

Figure 5:
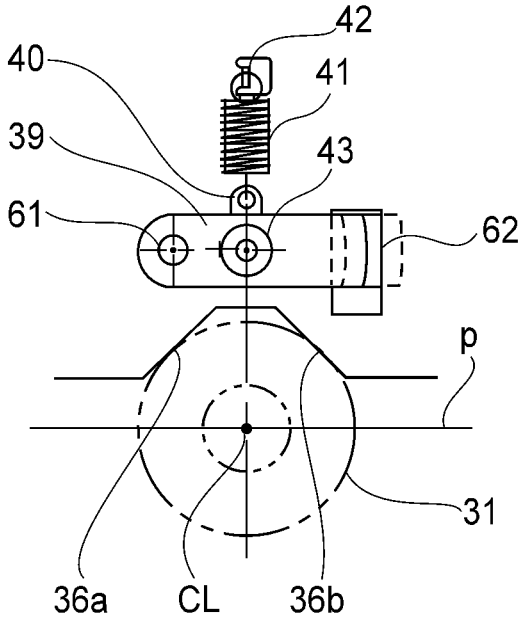
FIG. 5(*a*) is a schematic view of the cartridge positioning first slot 36 (36*a* and 36*b*) of the front plate 33, and the adjacencies of the portion 36, as seen from the front side, and FIG. 5(*b*) is a schematic view of the cartridge positioning second slot 38 (38*a* and 38*b*) of the rear plate 34, and the adjacencies of the portion 38, as seen from the front side.
Figure 5:
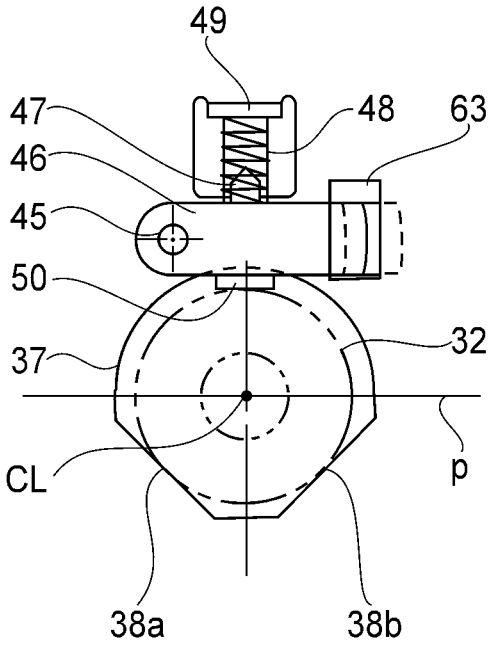
Figure 6:
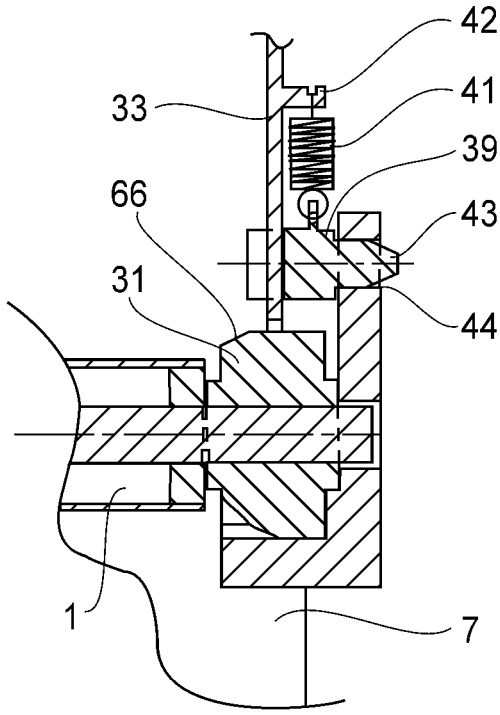
FIG. 6(*a*) is a schematic sectional view of the cartridge positioning first slot 36 (36*a* and 36*b*), and the portion of the photosensitive drum 1, which is in the adjacencies of the portion 36, at a vertical plane which coincides with the axial line of the photosensitive drum 1, and FIG. 6(*b*) is a schematic sectional view of the cartridge positioning second slot 38 (38*a* and 38*b*), and the portion of the photosensitive drum 1, which is in the adjacencies of the portion 38, at a vertical plane which coincides with the axial line of the photosensitive drum 1.
Figure 6:
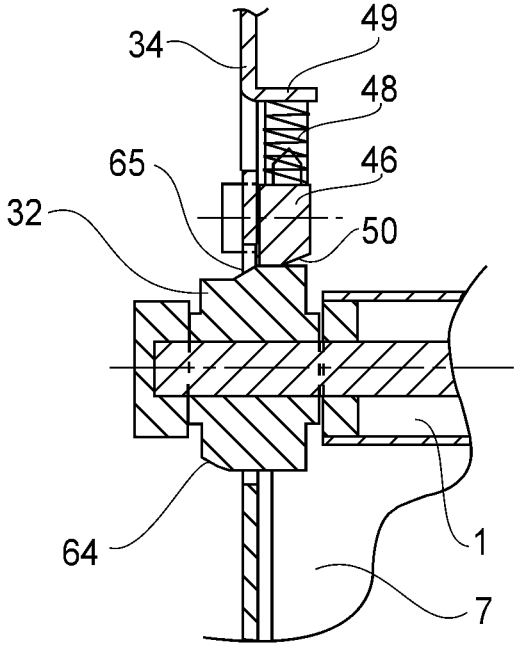

Next, referring to FIGS. 5 and 6, the method for pressing, and keeping pressed, the process cartridge 7 is described.

FIG. 5(*a*) is a schematic view of the cartridge positioning first slot 36 (36*a* and 36*b*), that is, the cartridge positioning slot of the front plate 33, and the adjacencies of the cartridge positioning first slot 36, as seen from the front side. Referring to FIG. 5(*a*), the front plate 33, which is the upstream plate in terms of the aforementioned cartridge insertion direction, has a first pressing means which presses the process cartridge 7 in the main assembly of the image forming apparatus 100 in the direction perpendicular to the lengthwise direction of the photosensitive drum 1 to precisely position the process cartridge 7 (photosensitive drum 1) relative to the main assembly in terms of the direction perpendicular to the cartridge positioning first slot 36. The first pressing means is made up of a front lever 39, a tensional spring 41, etc., which will be described later. The front lever 39 is the very portion with which the bearing 31 engages.

The front plate 33 is provided with a fulcrum shaft 61, which was attached to the front plate 33 by crimping, and is in the adjacencies of the cartridge positioning first slot 36 (36*a* and 36*b*). The aforementioned front lever 39 is fitted around the fulcrum shaft 61, by one (first end portion) of its lengthwise end portions, so that the front lever 39 can be rotationally moved around the fulcrum shaft 61. The front lever 39 is formed of slippery resin, and has a spring anchoring portion 40, which is roughly at the center of the front lever 39 in terms of the lengthwise direction of the front lever 39. It is with this spring anchoring portion 40 that the bottom end of the aforementioned tension spring 41 is in engagement, whereas the other end of the tension spring 41 is in engagement with a spring anchoring portion 42, with which the front plate 33 is provided. Thus, the front lever 39 remains under the pressure which works in the direction to rotate the front lever 39 in the counterclockwise direction about the fulcrum shaft 61. The second end of the front lever 39 is in a hole 62 of the front plate 33, and being thereby held by the front plate 33 while remaining under the pressure applied in the direction perpendicular to the cartridge positioning first slot 36 by the tension spring 41.

FIG. 6(*a*) is a schematic sectional view of the cartridge positioning first slot 36 (36*a* and 36*b*), and the portion of the photosensitive drum 1, which is in the adjacencies of the cartridge positioning first slot 36, at a vertical plane which coincides with the axial line of the photosensitive drum 1. Referring to FIG. 6(*a*), the front lever 39 has a boss 43, which is an integral part of the front lever 39 and is roughly at the center of the front lever 39 in terms of the lengthwise direction of the front lever 39. The shape and position of the boss 43 is such that the boss 43 fits in a hole 44 of the process cartridge 7. When the process cartridge 7 is properly in its image formation position in the main assembly, the attitude of the front lever 39 is such that the front lever 39 is slightly tilted in the clockwise direction. Also when the process cartridge 7 is properly in its image formation position in the main assembly, the boss 34 is in the hole 44 of the process cartridge 7. That is, as the process cartridge 7 is inserted into the main assembly, the boss 43 of the front lever 39 fits into the hole of the process cartridge 7, whereby the front lever 39 comes under the pressure applied thereto by the tension spring 41 in the direction perpendicular to the cartridge positioning first slot 36 (36*a* and 36*b*). Thus, the bearing 31 is placed in contact with the edges of the cartridge positioning first slot 36 (36*a* and 36*b*), whereby it is precisely positioned relative to the main assembly.

FIG. 5(*b*) is a schematic view of the cartridge positioning second slot 38 (38*a* and 38*b*), that is, the cartridge positioning slot of the rear plate 34, and the adjacencies of the cartridge positioning second slot 38, as seen from the front side. Referring to FIG. 5(*b*), the rear plate 34, which is the downstream plate in terms of the aforementioned cartridge insertion direction, has a second pressing means which presses the process cartridge 7 in the main assembly of the image forming apparatus 100 in the direction perpendicular to the lengthwise direction of the photosensitive drum 1 to precisely position the process cartridge 7 (photosensitive drum 1) relative to the main assembly in terms of the direction perpendicular to the cartridge positioning second slot 38. The second pressing means is made up of a rear lever 46, a tensional spring 48, etc., which will be described later. The rear lever 46 is the very portion with which the bearing 32 engages.

The rear plate 34 is provided with a fulcrum shaft 45, which was attached to the rear plate 34 by crimping, and is in the adjacencies of the cartridge positioning second slot 38 (38*a* and 38*b*). The rear lever 46 is fitted around the fulcrum shaft 45 so that it can be rotationally moved about the fulcrum shaft 45. It is above the opening 37. It has a boss 50 which projects downward from the roughly center of the bottom side of the rear lever 46, in terms of the lengthwise direction of the rear lever 46. It has also a boss 47, which projects upward from the roughly center of the top side of the rear lever 46. The boss 47 is fitted with a compression spring 48. The top end of the compression spring 48 is in a spring seat 49, which is an integral part of the rear plate 34. The spring 49 remains compressed, whereby it continuously applies pressure to the rear lever 46. Thus, the rear lever 46 remains under such pressure that works in the direction to rotate the rear lever 46 about the fulcrum shaft 45 in the clockwise direction. The other end of the rear lever 46 is in a hole 63 of the rear plate 34, being therefore held by the rear plate 34 while remaining pressed by the pressure from the compression spring 48 in the direction perpendicular to the cartridge positioning second slot 38 (38*a* and 38*b*).

FIG. 6(*b*) is a schematic sectional view of the cartridge positioning second slot 38 (38*a* and 38*b*), and the portion of the photosensitive drum 1, which is in the adjacencies of the cartridge positioning second slot 38, at a vertical plane which coincides with the axial line of the photosensitive drum 1. Referring to FIG. 6(*b*), the position of the bearing 32 is such that it is in contact with the bottom surface (projection 50) of the rear lever 46. When the process cartridge 7 is in its proper position for image formation in the main assembly, the attitude of the front lever 39 is such that the rear lever 46 is slightly tilted in the counterclockwise direction, applying thereby pressure upon the process cartridge 7. That is, as the process cartridge 7 is inserted into the main assembly, it engages with the rear lever 46, causing thereby the bearing 32 to be subjected to the pressure applied by the compression spring 48 in the direction perpendicular to the cartridge positioning second slot 38 (38*a* and 38*b*). Therefore, it is assured that the bearing 32 is placed in contact with the cartridge positioning second slot 38 (38*a* and 38*b*), being thereby precisely positioned relative to the main assembly.

As the process cartridge 7 is inserted into the main assembly of the image forming apparatus 100, one (bearing 31) of its lengthwise ends is pressed upward (which is perpendicular to cartridge positioning first slot 36 (36*a* and 36*b*)) by the front lever 39, whereby it is placed in contact with the cartridge positioning first slot 36, as described above. As for the other lengthwise end (bearing 32) of the process cartridge 7, as the process cartridge 7 is inserted into the main assembly, it is pressed downward (which is perpendicular to cartridge positioning second slot 38 (38*a* and 38*b*) by the rear lever 46, whereby it is placed in contact with the cartridge positioning second slot 38, which is on the opposite side of the process cartridge 7 from the cartridge positioning first slot 36 in terms of the vertical direction. This is how the process cartridge 7 is precisely positioned relative to the frame (front and rear plates 33 and 34) of the main assembly.

Next, referring to FIGS. 6(*a*) and 6(*b*), the positional relationship of each lever and each cartridge positioning slot relative to the process cartridge 7, and the movement of the process cartridge 7, which occurs as the process cartridge 7 is inserted into the main assembly of the image forming apparatus 100, are described.

First, the positional relationship of each lever and each cartridge positioning slot relative to the process cartridge 7 is described. Referring to FIG. 6(*a*), the position of the front lever 39 is such that when the process cartridge 7 is in the main assembly, the front lever 39 is above the process cartridge 7. The position of the cartridge positioning first slot 36 is such that when the cartridge 7 is in the main assembly, the cartridge positioning first slot 36 is above the photosensitive drum 1 which is in the top portion of the process cartridge 7. Next, referring to FIG. 6(*b*), the position of the rear lever 46 is such that when the process cartridge 7 is in the main assembly, the rear lever 46 also is above the process cartridge 7. The position of the cartridge positioning second slot 38 is such that when the cartridge 7 is in the main assembly, the cartridge positioning second slot 38 is below the photosensitive drum 1 which is in the top portion of the process cartridge 7.

Next, the operation for mounting the process cartridge 7 into the main assembly of the image forming apparatus 100 is described. The process cartridge 7 is to be inserted into the main assembly from the right-hand side in FIGS. 6(*a*) and 6(*b*), in such a manner that it is guided by cartridge insertion guides (unshown) of the main assembly.

As the process cartridge 7 is inserted, the bearing 31 (FIG. 6(*a*)), which is on the front side of the main assembly, comes into contact with the cartridge positioning first slot 36 (36*a* and 36*b*) by its guiding surface 66. At this point in time, the bearing 31 is not under the pressure from the tension spring 41, and therefore, there is virtually no friction between the bearing 31 and cartridge positioning first slot 36. Then, as the process cartridge 7 is inserted further into the main assembly, the boss 43 of the front lever 39 comes into contact with the edge of the hole 44 of the process cartridge 7, causing the force from the tension spring 41 to begin to press the bearing 31 in the direction perpendicular to the cartridge positioning first slot 36 (36*a* and 36*b*), via the front lever 39. Thus, this force from the tension spring 41 creates friction between the peripheral surface of the bearing 31 and the cartridge positioning first slot 36 (36*a* and 36*b*), and also, between the boss 43 and the wall of the hole 44. Therefore, the process cartridge 7 is set in the main assembly (precisely positioned relative to the main assembly) while being subjected to these frictions.

As for the rear end portion (rear side) of the main assembly of the image forming apparatus 100, as the process cartridge 7 is inserted into the main assembly, the guiding surface 65 of the bearing 32 (FIG. 6(*b*)) comes into contact with the cartridge positioning second slot 38 (38*a* and 38*b*). At this point in time, roughly half of the weight of the process cartridge 7 rests on the cartridge positioning second slot 38. Therefore, there is friction between the bearing 32 and the cartridge positioning second slot 38, although the friction is very small. Then, as the process cartridge 7 is inserted further into the main assembly, the slant surface of the projection 50 of the rear lever 46 comes into contact with the slant surface 65 of the bearing 32. From this point in time on, the force from the compression spring 48 acts in the direction perpendicular to the cartridge positioning second slot 38. This force from the compression spring 48, which is acting in the direction perpendicular to the cartridge positioning second slot 38 (rear plate 34) generates friction between the peripheral surface of the bearing 32 and the cartridge positioning second slot 38 (38*a* and 38*b*), and between the peripheral surface of the bearing 32 and the bottom surface of the rear lever 46. This friction functions as resistance.

Because of the above described positional relationship among these portions, that is, the direction in which the process cartridge 7 is supported, and the direction in which the process cartridge 7 is pressed, the upstream lengthwise end of the process cartridge 7 is pressed in the direction opposite to the direction in which the downstream lengthwise end of the process cartridge 7 is pressed. In other words, the direction in which the upstream lengthwise end of the process cartridge 7 is pressed against the cartridge positioning first slot 36 is opposite to the direction in which the downstream lengthwise end of the process cartridge 7 is pressed against the cartridge positioning second slot 38. Therefore, the process cartridge 7 is precisely positioned, and remains precisely position, relative to the main assembly of the image forming apparatus 100.

The above-described structural arrangement makes it possible to minimize the pressure applied to the process cartridge 7 at the deepest (rearmost) end portion of the main assembly of the image forming apparatus 100. That is, the cartridge positioning second slot 38 (38*a* and 38*b*) faces upward with respect to the direction perpendicular to the lengthwise direction of the photosensitive drum 1. That is, the process cartridge 7 remains subjected to the gravity. Therefore, the amount of force which the compression spring 48 is required to generate has only to be the difference between the amount of the force necessary to precisely position, and keep precisely positioned, the process cartridge 7 relative to the main assembly, and roughly half of the weight of the process cartridge 7. In other words, the above-described structural arrangement can minimize the amount of force necessary to insert the process cartridge 7 into the main assembly.

That is, because of the above described structural arrangement, the combination of the image forming apparatus 100 and the process cartridge 7 in this embodiment is significantly smaller in the amount of the friction generated between the bearing 32, that is, the rear bearing, and the rear lever 46 when the process cartridge 7 is mounted into, or removed from, the main assembly of the apparatus 100. Therefore, the combination is significantly smaller in the amount of force necessary for the process cartridge 7 to be mounted into, or removed from, the main assembly, being therefore significantly better in the handling of the process cartridge 7 when the process cartridge 7 is mounted into, or removed from, the main assembly than any combination of an image forming apparatus (100) and a process cartridge (7) in accordance with any of the prior arts.

An additional benefit of this structural arrangement is that it can minimize the amount of impact to which the photosensitive drum 7 may be subjected during its distribution. More specifically, in the case of a combination of an image forming apparatus and a process cartridge structured in accordance with the prior arts, the process cartridge is precisely position relative to the main assembly of the image forming apparatus by being pressed in only one direction perpendicular to the direction in which it is mounted into the main assembly. Therefore, when an image forming apparatus in accordance with the prior arts happened to be dropped during its distribution, the amount of shock to which the process cartridge was subjected was substantial, causing sometimes the process cartridge to be significantly displaced, which sometimes resulted in the damages to the process cartridge.

In comparison, in the case of the combination of the image forming apparatus and process cartridges in this embodiment, if a shipment package which contains the combination happens to be dropped, the bearing 31 is temporarily separated from the cartridge positioning first slot 36 (36*a* and 36*b*) against the force from the tension spring 41 as the package hits the ground. Then, the bearing 31 is subjected to the shock which is generated as it is placed back in contact with the cartridge positioning first slot 36 by the force from the tension spring 41.

On the other hand, the lengthwise rear end portion (which corresponds to rear end portion of apparatus) of the process cartridge 7 is supported by the cartridge positioning second slot 38 (rigid portion), which is on the opposite side from the cartridge positioning first slot 36. Therefore, it does not change in position even if a shipment package which contains the image forming apparatus which contains the process cartridges happens to be dropped. Instead, the process cartridge 7 changes in attitude, that is, it rotationally moves about the cartridge positioning second slot 38 (which corresponds to rear end portion of process cartridge 7) in such a manner that its front end displaces by an amount larger than the amount by which the other portion of the process cartridge 7. Thus, the process cartridge 7 in this embodiment is significantly smaller in the amount by which it is displaced when a shipment package which contains the image forming apparatus 100 in which the process cartridge 7 is present is dropped, being therefore significantly smaller in the amount of shock to which it is subjected when it is restored in position, than a combination of an image forming apparatus and process cartridges in accordance with the prior arts.

Further, in this embodiment, the rear end of the process cartridge 7 (which corresponds to rear end of image forming apparatus) does not displace in the direction perpendicular to the rear cartridge positioning second slot 38, being therefore significantly smaller in the amount of displacement which might occur in the direction parallel to the rotational axis of the photosensitive drum 1 if the image forming apparatus is subjected to a substantial amount of shock, than the combination of an image forming apparatus and process cartridges in accordance with the prior arts.

That is, in this embodiment, as the process cartridge 7 is mounted into the main assembly of the image forming apparatus 100, it is precisely positioned relative to the main assembly in such a manner that even if the image forming apparatus 100 is subjected to a substantial mount of shock, the process cartridge 7 is unlikely to be affected by the shock. Therefore, in the case of the combination of the image forming apparatus 100 and process cartridge(s) 7 in this embodiment, even if a shipment package which contains the image forming apparatus 100 in which the process cartridges 7 have been precisely positioned is subjected to external shock during the distribution of the package, each of the process cartridges 7, and the photosensitive drum 1 in each process cartridge 7, remain precisely positioned relative to the main assembly.

Further, even if the process cartridge in the image forming apparatus 100 in a shipment package is subjected to upward impact, that is, even if a shipment pack which contains the image forming apparatus 100 in which the process cartridge 7 has been precisely position is dropped upside down, all that occurs to the process cartridge 7 is that the direction of the force to which the process cartridge 7 is subjected becomes opposite to the direction of the force to which the package is dropped in the normal attitude. Therefore, the amount of shock to which the process cartridge 7 is subjected is just as small as the amount of shock to which the process cartridge 7 is subjected when the package is dropped in the normal attitude. Therefore, the photosensitive drum 1 remains precisely positioned relative to the main assembly.

If a shipment box which contains the image forming apparatus 100 happens to fall with the left or right side of the box facing downward, the process cartridge 7 might shifts in position. However, the state of contact between the cartridge positioning first slot 36 (36*a* and 36*b*) and the bearing 31, and the state of contact between the cartridge positioning second slot 38 (38*a* and 38*b*) and the bearing 31, remains unchanged. Therefore, the shock to which the process cartridge 7 is subjected is not as large as when the shipment box falls in the normal attitude or upside down.

Further, the above described image forming apparatus in this embodiment employs multiple process cartridges, and it is roughly in the roughly horizontal direction that the cartridges are mounted into, or removed from, the main assembly of the image forming apparatus. It has: the transfer unit which is in the top portion of the main assembly, and has the endless belt which is in contact with all of the photosensitive drum 1; and the exposing means which is in the bottom portion of the main assembly, and forms a latent image on each photosensitive drum 1 by exposing the photosensitive drum 1. Because it (multicolor image forming apparatus; color image forming apparatus) is structured as described above, it is superior to a multicolor image forming apparatus in accordance with the prior arts, in terms of how a user has to handle a process cartridge during the mounting or removal of the process cartridge.

Figure 7:
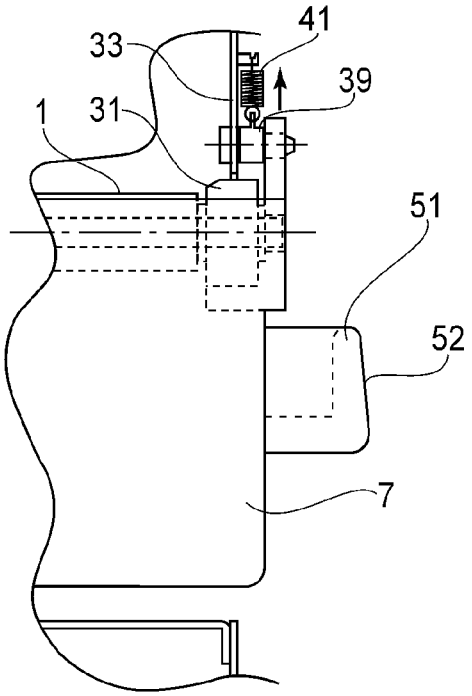
FIG. 7 is a partially sectional view of the handle portion of the process cartridge 7 when the process cartridge 7 is in its image formation position in the main assembly.

Next, referring to FIG. 7, the structure of the handle of the process cartridge 7 is described. FIG. 7 is a partially sectional view of the process cartridge 7, as seen from the left side of the image forming apparatus, when the process cartridge 7 is in its image formation position in the main assembly.

Referring to FIG. 7, the process cartridge 7 has a handle 51, which is at the front end of the process cartridge 7, that is, the upstream end of the process cartridge 7 in terms of the direction in which the process cartridge 7 is inserted into the main assembly of the image forming apparatus 100. This handle 51 is an integral part of the shell portion of the process cartridge 7. The handle 51 is L-shaped in cross section. The shape of the handle 51 was determined based on the direction in which the cartridge positioning first slot 36 (36*a* and 36*b*) faces, and the direction in which the front lever 39 presses upon the process cartridge 7 (bearing 31).

That is, the handle 51 is shaped so that when a user mounts or removes the process cartridge 7, the back of the user's hand faces the same direction as the direction (indicated by arrow mark in FIG. 7) in which the front lever 39 presses upon the process cartridge 7 (bearing 31). In this embodiment, the front lever 39 presses the process cartridge 7 upward (indicated by arrow mark in FIG. 7). Therefore, the handle 51 is L-shaped in cross section, as shown in FIG. 7, so that all that is necessary for the user to do to remove the process cartridge 7 from the main assembly of the image forming apparatus is to place his- or her hand on the handle 51, and pull the handle 51 in the rightward of FIG. 7, by hooking the portion of the handle 51, which is parallel to the surface of the cartridge shell, with his- or her fingers.

That is, the process cartridge 7 is structured so that the handle 51 is on the front surface (upstream side in terms of cartridge insertion direction) of the process cartridge 7, and is positioned so that when the process cartridge 7 is positioned to be mounted or removed, it will be below the axial line of the photosensitive drum 1, and also, so that its recess faces toward the direction of the cartridge positioning first slot 36.

Because the handle 51 is structured and positioned as described above, as a user pulls the process cartridge 7 in the main assembly of the image forming apparatus 100 to remove it from the main assembly, the process cartridge 7 is subjected to only a small amount of horizontal force, or a small amount of force which is slightly offset from the horizontal direction; there is generated no upward force which acts on the process cartridge 7.

That is, when the process cartridge 7 is pulled outward for the removal from the main assembly of the image forming apparatus 100, the amount of pressure by which the bearing 31 is pressed upon the cartridge positioning first slot 36 does not increase, and therefore, the friction between the cartridge positioning first slot 36 and bearing 31 does not increase. The amount of force necessary to remove the process cartridge 7 from the main assembly does not change regardless of how the process cartridge 7 is pulled and/or the direction in which the process cartridge 7 is pulled. That is, the combination of the image forming apparatus 100 and process cartridges 7 in this embodiment is stable in the amount of force necessary to remove the process cartridges 7 from the main assembly of the image forming apparatus 100, being therefore superior to a combination of an image forming apparatus and process cartridges in accordance with the prior arts, in terms of the requirement regarding how the process cartridges have to be handled when they need to be removed from the main assembly.

Further, the tension spring 41 is designed so that the amount of force it generates is the smallest amount necessary to precisely position the process cartridge 7 relative to the main assembly of the image forming apparatus 100. Therefore, the image forming apparatus in this embodiment is smaller in the amount of force necessary to remove the process cartridge 7 from the main assembly of the image forming apparatus than an image forming apparatus in accordance with the prior arts.

Figure 8:
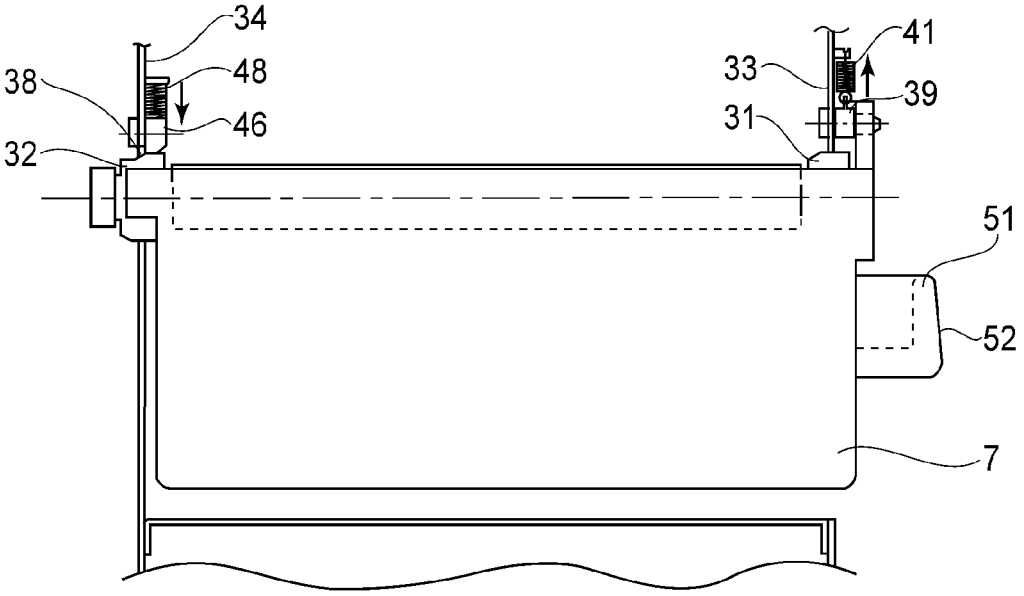
FIG. 8 is a sectional view of the handle portion of the process cartridge 7 when the process cartridge 7 is in its image formation position in the main assembly.

In comparison, the amount by which the rear end portion of the process cartridge 7 (rear end of apparatus) is affected by the direction in which the process cartridge 7 is pulled to be removed from the main assembly is small. That is, the distance between the handle 51 and the cartridge positioning second slot 38 is substantial as shown in FIG. 8. Thus, even if downward force is applied to the process cartridge 7 by a user as the user pulls the process cartridge 7 to remove the process cartridge 7, the downwardly applied force turns into such a force that causes the process cartridge 7 to be rotationally moved about the cartridge positioning second slot 38. Therefore, the downwardly applied force has little effect upon the friction between the cartridges positioning second slot 38 and bearing 32.

Further, when it is necessary to mount the process cartridge 7 into the main assembly of the image forming apparatus 100, the front surface of the handle 51 is to be pressed in the direction in which the process cartridge 7 is to be mounted. Referring to FIGS. 7 and 8, the front surface 52*a* of the handle 51 has a preset angle (5° in this embodiment) relative to the vertical direction.

Therefore, as a user presses the front surface 52*a* of the handle 51 to mount the process cartridge 7 in the main assembly of the image forming apparatus 100, the process cartridge 7 is subjected to the horizontal force and a small amount of force which is slightly downwardly angled relative to the horizontal direction, with the presence of no upward force. Therefore, the image forming apparatus in this embodiment is smaller in the amount of force necessary to mount the process cartridge 7 into the main assembly of the image forming apparatus than any of the image forming apparatuses in accordance with the prior arts.

Further, in this embodiment, the front surface 52 of the handle 51 is tilted by a preset angle. However, this structural feature in this embodiment is not intended to limit the present invention in scope. For example, the front surface 52 may have a curvature. What is essential here is that the front surface 52 is shaped and/or angled so that as the front surface 52 is pressed by a user, the force applied to the surface 52 by the user reduces the friction between the cartridge positioning first slot 36 and bearing 31 (applied force does not increase the friction between the cartridge positioning first slot 36 and bearing 31) so that the process cartridge 7 can be reliably mounted.

The force applied to the front surface 52 of the handle 51 by a user to mount the process cartridge 7 as described above has little effect upon the friction between the cartridge positioning second slot 38 and bearing 32 which are in the rear end portion of the main assembly.

By structuring the handle 51 of the process cartridge 7 as described above, it is possible to reduce, and also, make stable, a combination of an image forming apparatus and a process cartridge in the amount of force necessary to mount the process cartridge into the main assembly of the image forming apparatus, and to remove the process cartridge from the main assembly.

Further, in this embodiment, the image forming apparatus is structured so that as the bearings 31 and 32 of the photosensitive drum 1 come into contact with the cartridge positioning first and second portions 36 and 38 (slant edges of the V-shaped cut) of the corresponding metallic side plate of the main assembly, the process cartridge 7 is precisely positioned relative to the main assembly. Therefore, the combination of the image forming apparatus and the process cartridge therefor in this embodiment is superior to any of a combination of an image forming apparatus and process cartridge therefor in accordance with the prior arts, in terms of the preciseness with which the process cartridges are positioned relative to the main assembly, amount of force necessary to mount or remove the process cartridge, and reliability with which a process cartridge can be mounted or removed.

The preceding embodiment of the present invention was described with reference to the multicolor image forming apparatus (color image forming apparatus) which employs four process cartridges which are removably mountable in the main assembly of the apparatus. However, the embodiment is not intended to limit the present invention in scope. That is, the number of the process cartridges to be employed by an image forming apparatus is optional. Further, the type of an image forming apparatus to which the present invention is applicable is not limited to a color image forming apparatus. That is, the present invention is also applicable to a monochromatic image forming apparatus.

Further, a "cartridge having at least an image bearing member" means such a process cartridge as the above described process cartridge that is removably mountable in the main assembly of an image forming apparatus, and contributes to the process for forming an image on recording medium. The process cartridge described above comprised: an electrophotographic photosensitive drum (image bearing member); at least one processing means among the charging means, developing means, and cleaning means; and a cartridge in which the photosensitive drum and one or more processing means were integrally placed so that they can be removably mountable in the main assembly of an image forming apparatus. In other words, a "process cartridge" includes a cartridge which integrally contains a photosensitive drum and a developing means (processing means) and is removably mountable in the main assembly of an image forming apparatus. It includes also a cartridge which integrally contains a photosensitive drum, a charging means, and a developing means or cleaning means and is removably mountable in the main assembly of an image forming apparatus. Incidentally, a "processing means" is a means for processing a photosensitive drum.

Further, in the preferred embodiment of the present invention described above, the exposing means was a laser scanner. However, the exposing means does not need to be limited to a laser scanner. For example, it may be an LED array or the like. That is, even though the image forming apparatus in the preferred embodiment of the present invention described above was a laser printer, the present invention is also applicable to an LED printer or the like. Moreover, the application of the present invention is not limited to a plain image forming apparatus. For example, the present invention is also applicable to a copying machine, a facsimile machine, a word processor, etc., and a multifunction image forming apparatus capable of performing a combination of the functions of the preceding image forming apparatuses. The application of the present invention to these image forming apparatuses yields the same effects as those described above.

Further, in the preferred embodiment of the present invention described above, the endless belt of the belt unit was an intermediary transfer belt (intermediary transfer member), that is, a belt on which a toner image is temporarily transferred. However, the compatibility of the present invention is not limited to a transfer belt unit. For example, the present invention is also compatible with an image forming apparatus which employs a conveyance belt unit, that is, a belt unit which uses an endless belt for conveying recording medium onto which a toner image is transferred. The application of the present invention to such an image forming apparatus also yields the same effects as those described above.

According to the present invention, it is possible to precisely position a process cartridge relative to the main assembly of an image forming apparatus in such a manner that even if the image forming apparatus is subjected to an external shock while the image forming apparatus contains a process cartridge precisely positioned relative to the main assembly of the apparatus, the process cartridge is unlikely to be affected by the shock. In other words, the present invention makes it possible to provide a combination of an image forming apparatus and a process cartridge, which can keep the process cartridge, and the image bearing member therein, precisely positioned relative to the main assembly even if the combination is subjected to an external shock while the combination is being distributed, with the process cartridge being precisely positioned relative to the main assembly, in the main assembly.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 017580/2010 filed Jan. 29, 2010 which is hereby incorporated by reference.

What is claimed is:

1. An image forming apparatus for forming an image on a recording material, wherein a cartridge including at least a photosensitive drum is detachably mountable to said image forming apparatus, said image forming apparatus comprising:

a first abutting portion provided on an upstream side with respect to a mounting direction in which the cartridge is moved in its longitudinal direction when being mounted to said apparatus;

a first urging means provided on the upstream side with respect to the mounting direction, for urging, when the cartridge is mounted to said apparatus, the cartridge in a direction crossing with a center axis of the photosensitive drum so as to position the cartridge in the crossing direction;

a second abutting portion provided on a downstream side with respect to the mounting direction; and a second urging means provided on the downstream side with respect to the mounting direction, for urging, when the cartridge is mounted to said apparatus, the cartridge in a direction crossing with the center axis of the photosensitive drum so as to position the cartridge in the crossing direction, wherein said first abutting portion and said second abutting portion are disposed opposite from each other with respect to a plane that includes the center axis and is perpendicular to the crossing directions, wherein the direction in which said first urging means urges the cartridge is opposite the direction in which said second urging means urges the cartridge.

2. An apparatus according to claim 1, wherein said first urging means and said second urging means urge bearing members rotatably supporting said photosensitive drum.

3. An apparatus according to claim 1, further comprising a frame of a metal plate, wherein said first abutting portion and said second abutting portion are end surfaces of openings formed in said frame.

4. An apparatus according to claim 1, wherein, in a state that the cartridge is mounted to said image forming apparatus, said first abutting portion is above the photosensitive drum, and said second abutting portion is below the photosensitive drum.

5. An apparatus according to claim 4, wherein said first urging means includes an engaging portion engageable with the cartridge when the cartridge is mounted to said image forming apparatus and a tension spring for urging said engaging portion upwardly, and wherein said second urging means includes an urging portion for urging the cartridge when the cartridge is mounted to said image forming apparatus, and a compression spring for urging said urging portion downwardly.

6. An apparatus according to claim 1, wherein said image forming apparatus is capable of being loaded with a plurality of such cartridges that are mountable to said image forming apparatus substantially in a horizontal direction, and wherein said image forming apparatus comprises a transfer belt unit including an endless belt contacted to the photosensitive drums of the cartridge at an upper part, and exposure means, provided at a lower part, for exposing the photosensitive drums to image light for latent image formation.

* * * * *